United States Patent [19]

Hansen

[11] Patent Number: 4,673,034

[45] Date of Patent: Jun. 16, 1987

[54] CASED WATER WELLS HAVING FLEXIBLE PAD

[76] Inventor: Donald J. Hansen, 133 Elm St., Elkins, W. Va. 26241

[21] Appl. No.: 816,260

[22] Filed: Jan. 6, 1986

[51] Int. Cl.[4] ..... E21B 33/02

[52] U.S. Cl. ..... 166/75.1; 166/81; 175/211; 277/212 F

[58] Field of Search ..... 166/81, 82, 84, 85, 166/88, 92, 75.1; 277/212 F; 175/211; 52/102

[56] References Cited

U.S. PATENT DOCUMENTS

| | | | |
|---|---|---|---|
| 113,638 | 4/1871 | Dewey | 166/81 |
| 319,924 | 6/1985 | Myers . | |
| 507,777 | 10/1893 | Berger et al. | 285/42 |
| 1,494,234 | 5/1924 | Gossett | 285/42 |
| 1,540,192 | 5/1925 | Smith | 285/42 |
| 1,904,926 | 4/1933 | Peters | 166/75 |
| 2,054,308 | 9/1936 | Tucker | 285/42 |
| 2,079,835 | 5/1937 | Bradley | 166/75 |
| 2,532,341 | 12/1950 | Shannon | 166/96 |
| 2,697,240 | 12/1954 | Barnes et al. | 166/82 |
| 2,800,254 | 7/1957 | Dinkelkamp | 277/212 F |
| 2,985,465 | 5/1961 | Church | 285/42 |
| 3,477,181 | 11/1969 | Robinson | 52/103 |
| 3,571,972 | 3/1971 | Carter, Jr. | 47/25 |
| 3,650,072 | 3/1972 | Matvey | 52/102 |
| 3,704,004 | 11/1972 | Carter, Jr. | 256/1 |
| 3,708,185 | 1/1973 | Bilicki | 285/42 |
| 3,722,587 | 3/1973 | Diaz | 166/88 |
| 3,788,655 | 1/1974 | Hathaway | 277/212 F |
| 4,120,129 | 10/1978 | Nagler et al. | 52/219 |
| 4,145,584 | 11/1889 | Reidy | 92/161 |
| 4,160,347 | 7/1979 | Logsdon | 52/199 |
| 4,211,423 | 7/1980 | Resech | 277/212 |
| 4,470,606 | 9/1984 | Knowles | 277/27 |

FOREIGN PATENT DOCUMENTS

| | | | |
|---|---|---|---|
| 0445951 | 1/1948 | Canada | 166/88 |
| 2752309 | 5/1979 | Fed. Rep. of Germany | 175/211 |

OTHER PUBLICATIONS

*Water Well Design Standards*—Virginia Board of Health, Chapter 16-1, Series 111 (1984).

Recommendations of the U.S. Public Health Services Food and Drug Administration (1978), pp. 112, 114.

*Primary Examiner*—George A. Suchfield
*Assistant Examiner*—Terry Lee Melius
*Attorney, Agent, or Firm*—Curtis, Morris & Safford

[57] ABSTRACT

A cased water well comprising a generally tubular water well casing extending from subgrade to above grade. A flexible pad is attached to the water well casing for preventing aquifier contamination. The pad has an upwardly extending, generally tubular, flexible and water impermeable neck which is circumferentially continuous. The neck has an axially disposed opening which is adapted to be removably received over the upper terminus of the well casing and the neck is compressibly and sealingly attached to the outer surface of the well casing. A water impermeable flexible skirt is sealingly attached to the neck and extends radially outwardly a substantial distance in all directions from the neck. The flexible skirt has a lower surface which is adapted to be in contact with the earth and an upper surface which slopes continuously downwardly and outwardly from the neck to the outermost edges of the skirt.

10 Claims, 6 Drawing Figures

CASED WATER WELLS HAVING FLEXIBLE PAD

FIELD OF THE INVENTION

The present invention relates to cased water wells and in particular to pads for such cased water wells.

BACKGROUND OF THE INVENTION

Water wells are commonly used for providing domestic water in rural areas and in some suburban areas. Such wells are commonly constructed by drilling, boring, or otherwise excavating a hole into the ground from the surface into a water-bearing stratum or aquifer. To prevent collapse of the hole, a generally tubular casing is inserted through the hole into the aquifer. This casing extends from the aquifer to above grade level, where the casing terminates and is typically covered by a sanitary well cap.

The casing will typically have an opening in it called a pitless well adapter for connection of piping for removal of the water. This opening is commonly placed below grade level, below the frost line, to prevent freezing of pipes attached to the opening in the casing. A pump or other means for extracting the water from the aquifer and raising it to the level of the opening in the casing is commonly attached at or near the upper terminus of the well casing, usually to the well casing itself.

Water found near the surface of soil, and indeed rain water itself, may contain significant contaminants. Furthermore, surface water will readily seep downwardly, or channel, immediately adjacent to the well casing. If contaminated surface water is allowed to contact the outside of the casing before it has percolated through several feet of soil to filter and purify the water through the action of bacteria, contaminated water can readily channel down adjacent to the casing and enter the aquifer, causing pollution.

To prevent this, cased water wells typically include a concrete pad surrounding the casing, and extending a substantial distance in all directions from the casing. This concrete pad has an upper surface which is sloped away from the casing so that rain water, dirt, oils from the pump or other contaminants will be drained away from the well casing to the outer edge of the concrete pad. Thus, surface water drained off the pad must percolate through several feet of soil before coming in contact with the outside of the casing.

The installation of this concrete pad is costly from the standpoint of time and material. Installing the concrete pad requires extra excavation of the soil around the upper portion of the well casing and a form for pouring the concrete.

The concrete pad must be free from cracks and the outside of the casing where it contacts the concrete must be sealed with a mastic or other sealant to prevent water from seeping through the concrete pad adjacent the outside of the casing at the point of entry of the casing. If the concrete pad is formed too soon after excavation of the soil around the casing, subsequent ground settling can cause cracking of the concrete which would defeat the purpose of the pad. Such ground settling can also cause rupturing of the mastic seal around the well casing, similarly defeating the purpose of the concrete pad. Furthermore, dirt can accumulate around the well casing at the point of entry through the concrete pad, contributing to weed and grass growth which, in turn, contributes to channeling of water through this point of entry down the outside of the casing.

The concrete pad may be installed either at or near grade level or below grade level, below the pitless well adapter. When installed at or near grade level, inspection or repair of the pitless adapter below the concrete pad requires a great deal of excavation below the pad which, in turn, subjects the concrete pad to the potential for cracking and rupture of the mastic seal. Furthermore, inspection and excavation under the concrete pad can be very dangerous to personnel. Installation of the concrete pad below the pitless well adapter to minimize these problems requires much more excavation and resultant expense. In either case, concrete can only be installed within a certain range of temperatures, which prevents the installation of wells during times of the year when temperatures are too cold.

OBJECTS OF THE INVENTION

Accordingly, it is an object of the present invention to provide a water impermeable pad for deflecting surface water away from a well casing which is simple and inexpensive to install.

It is a further object of the present invention to provide a water impermeable pad which is flexible and which can adjust to uneven ground surfaces to insure proper drainage of water away from the well casing.

It is a still further object of the present invention to provide a water impermeable pad which can be installed without regard to surrounding temperature conditions.

It is a yet further object of the present invention to provide a water impermeable pad which can be conveniently installed over the upper terminus of the well casing, and removed without damage to the water impermeable pad whenever maintenance is necessary.

SUMMARY OF THE INVENTION

These and other objects of the present invention are achieved by the use of a flexible pad for attachment to a water well casing. This pad has a water impermeable flexible skirt which has an opening generally centrally disposed therein for receiving the upper terminus of a water well casing therethrough. Means are provided for sealably attaching this skirt at that opening to the water well casing.

In a preferred embodiment of the present invention, the pad has an upwardly extending, generally tubular, flexible and water impermeable neck. The neck is circumferentially continuous and has an axially disposed opening therethrough which is adapted to be removably received over the upper terminus of the well casing. The neck is compressibly and sealingly attached to the outer surface of the casing so that the connection is watertight. The pad also includes a water impermeable flexible skirt sealingly attached to this neck extending radially outwardly a substantial distance in all directions from the neck. This flexible skirt has a lower surface adapted to be in contact with the earth and an upper surface sloping continuously downwardly and outwardly from the neck to the outermost edge of the skirt.

In another preferred embodiment of the present invention, the skirt is integral with the neck.

The above and other objects, features and advantages of the present invention will be apparent from the following detailed description of an illustrative embodiment thereof which is to be read in conjunction with the accompanying drawings.

DETAILED DESCRIPTION OF THE PREFERRED EMBODIMENT

Figure 6:
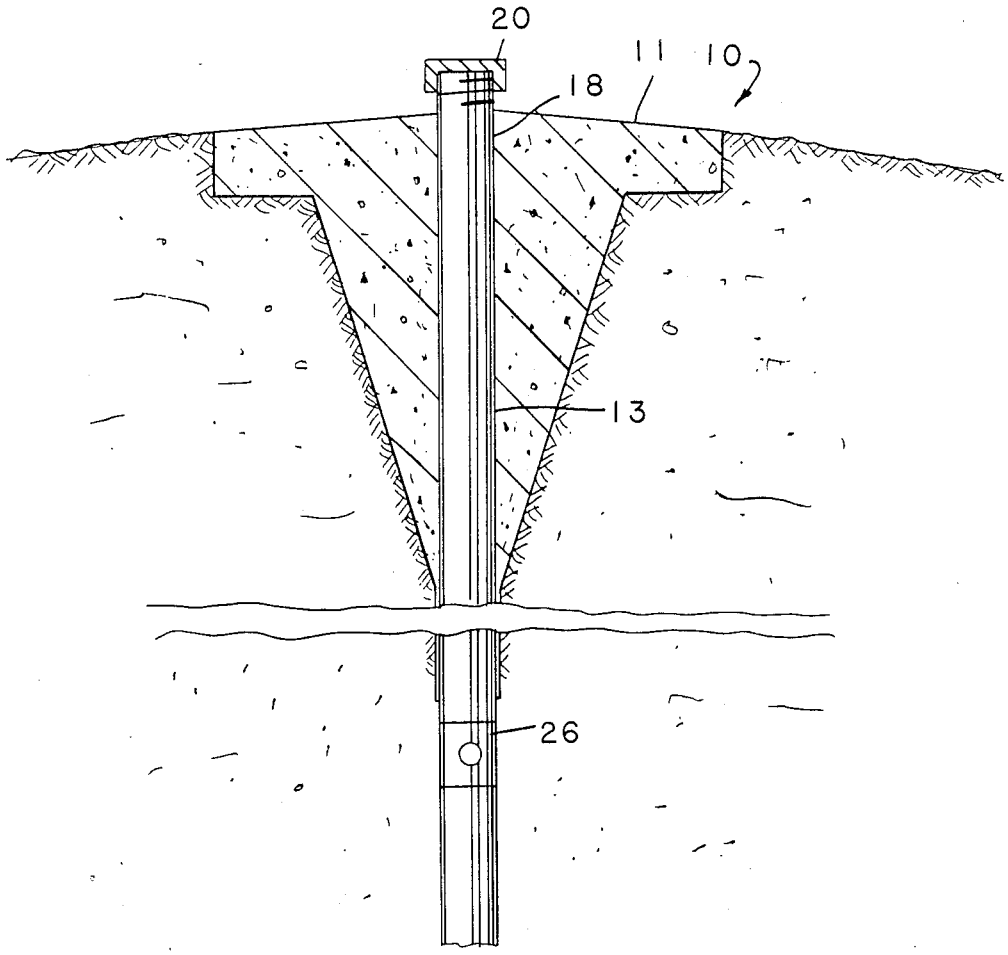
FIG. 6 is a cross sectional view of a concrete pad of the prior art, installed at grade level surrounding a well casing.

Referring first to FIG. 6, a cased water well having a concrete pad 10 in accordance with the prior art is illustrated. The concrete pad is formed in place around the well casing 18, and extends a substantial distance away from the well casing. The upper surface 11 of the concrete is sloped away from the well casing to provide drainage of surface water away from the casing. The concrete is formed in place and is rigid. To prevent water from seeping down between the casing and the concrete pad, a mastic or sealing compound 13 is installed between the concrete pad and the outside surface of the well casing.

Figure 1:
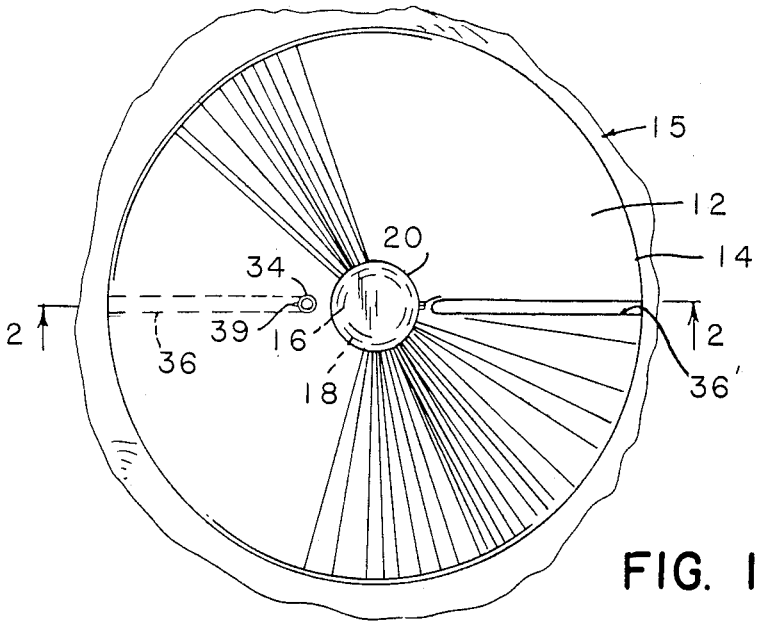
FIG. 1 is a plan view of the flexible pad of one preferred embodiment of the present invention.
Figure 2:
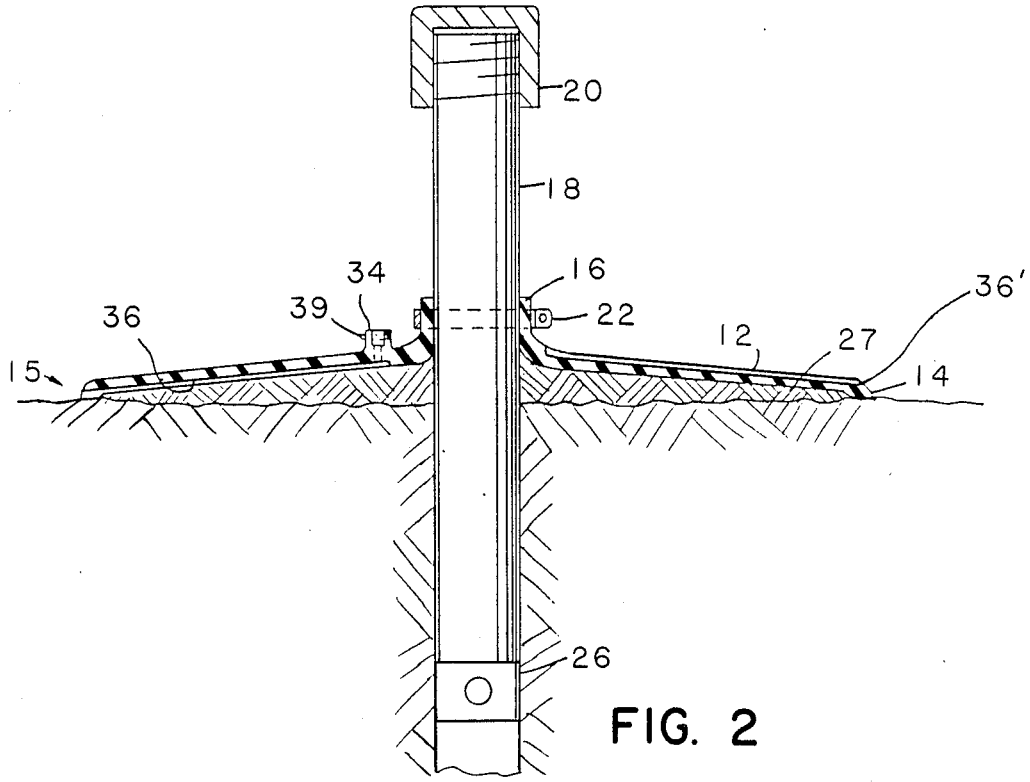
FIG. 2 is a cross sectional view of the flexible pad of FIG. 1, shown installed onto a well casing at grade level.

Referring now to FIGS. 1 and 2, a flexible water impermeable pad 15 in accordance with one embodiment of the present invention is illustrated. The pad has a generally disc-shaped or circular skirt 12 with a continuous outer periphery or edge 14. This skirt is water impermeable and is dimensioned so that it extends radially away from the casing a substantial distance, preferably two feet or more. Further, its upper surface slopes away from the well casing continuously and downwardly in all directions. This ensures that any contaminants which may impinge on the skirt will be washed away from the well casing and avoids channeling of contaminated water adjacent to the well casing.

Skirt 12 of pad 15 should be made of a durable and flexible material, for example, rubber or neoprene or any suitable synthetic material. Preferably, skirt 12 is formed of a material which will withstand constant contact with the soil without undue degradation, since at least the lower surface of the flexible pad will constantly be in contact with soil. Furthermore, when the flexible pad is installed at grade level, the upper surface of the pad will be exposed to light and oxygen, and must also resist degradation from these environmental effects.

The skirt 12 connects to an upwardly extending generally tubular and circumferentially continuous neck 16 which is generally centrally disposed with respect to the outer edges of the skirt. Neck 16 is adapted to be received over the upper terminus of the well casing 18 when the sanitary cap 20 is removed. As illustrated in FIGS. 1 and 2, neck 16 is integral with skirt 12, although it is readily apparent that the neck could also be formed separately from the skirt, and suitably attached to the skirt in any suitable manner to prevent leakage between the neck and the skirt, such as gluing, heat sealing, or a bolt and gasket connection.

The neck 16 of the pad 15 should preferably be formed of a durable elastomeric material such as rubber or neoprene. These materials are sufficiently elastic to fit snugly over the well casing, and can be sealed watertight to the well casing conveniently with an ordinary compression hose clamp 22.

Figure 5:
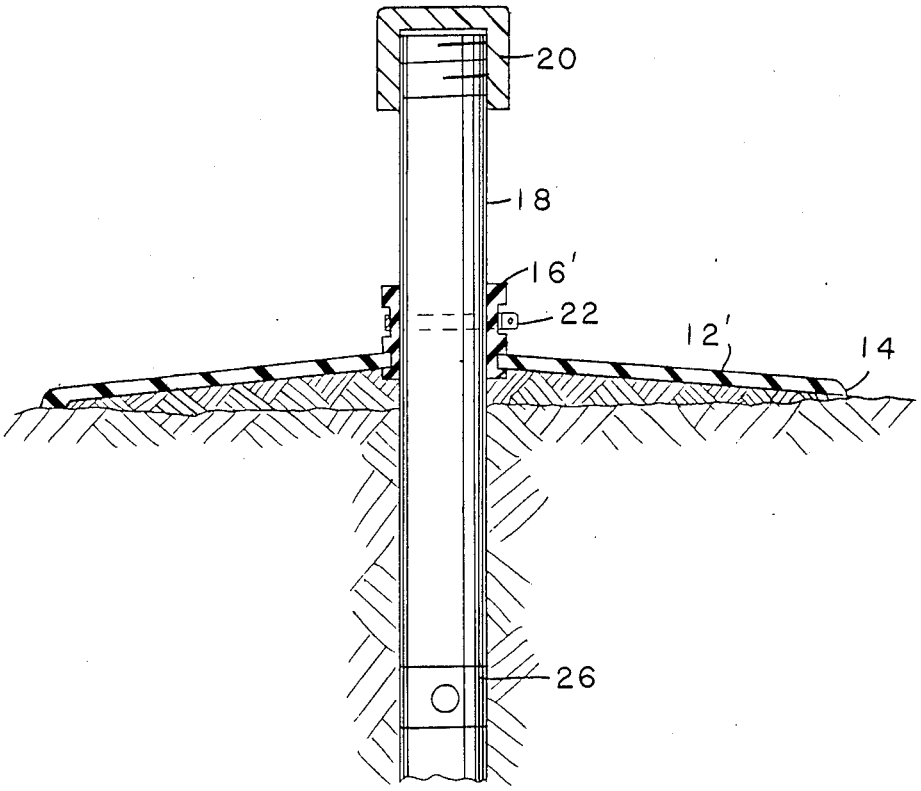
FIG. 5 is a cross sectional view of the flexible pad of the present invention, with a separate skirt and neck-gasket.

The skirt 12 can also be formed of other flexible materials such as polypropylene or similar plastics. In that case sealing of the pad to the well casing requires a separate elastomeric neck-gasket 16' between the skirt 12' and the well casing, as illustrated in FIG. 5, to seal the skirt to the well casing. When this construction is used, the neck-gasket 16' extends to the lowest surface of skirt 12'. In this manner, downward pressure on the upper-outside extremity of the skirt causes pressure against the lowest surface of the skirt to relieve stress around the compression hose clamp 22.

To install the flexible pad of the present invention onto a well casing, one excavates around the casing a sufficient distance so that the pitless well adapter 26 can be installed around the well casing. This excavation is then backfilled. The surface of the soil 27 surrounding the casing is built up and sloped away from the casing with approximately the same slope as is desired for the skirt 12 of flexible pad 15, when it is installed. The sanitary cap 20 is then removed from the upper terminus of the well casing, and the opening of the neck 16 of the flexible pad slipped over the upper end of the well casing and lowered until the lower surface of the flexible pad is resting on the sloped soil. The compression hose clamp 22 is then placed over the neck of the flexible pad and tightened, creating a secure, watertight seal between the neck and the well casing. Because the pad is flexible, the pad will not crack or break the seal between the neck and the well casing in the event of subsequent ground settling. Thus, the flexible pad can be installed immediately after backfilling the excavation. Furthermore, because the pad does not need to be formed in place, the pad can be installed in a wide variety of temperature conditions.

Figure 3:
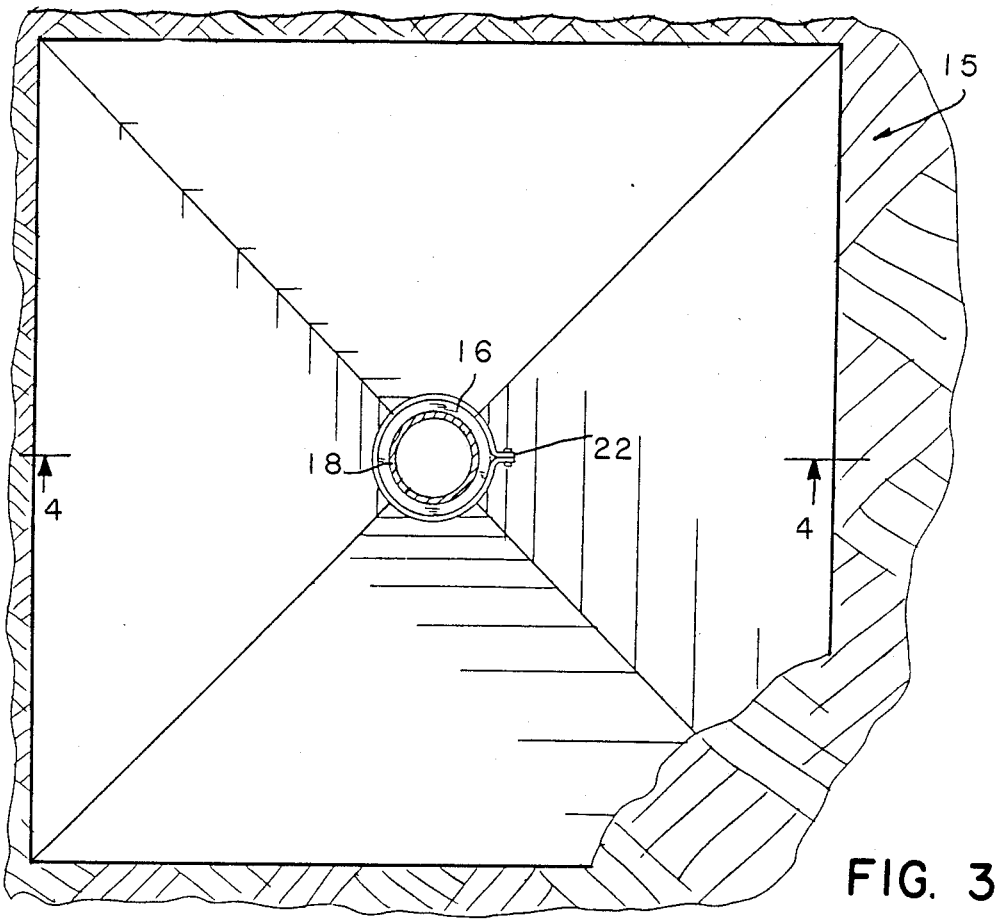
FIG. 3 is a plan view of a flexible pad in accordance with another embodiment of the present invention.

The pad of the present invention need not be circular as illustrated in FIG. 1, but can be any shape. Thus, the pad may have a rectilinear or square cross section, as illustrated in FIG. 3.

Figure 4:
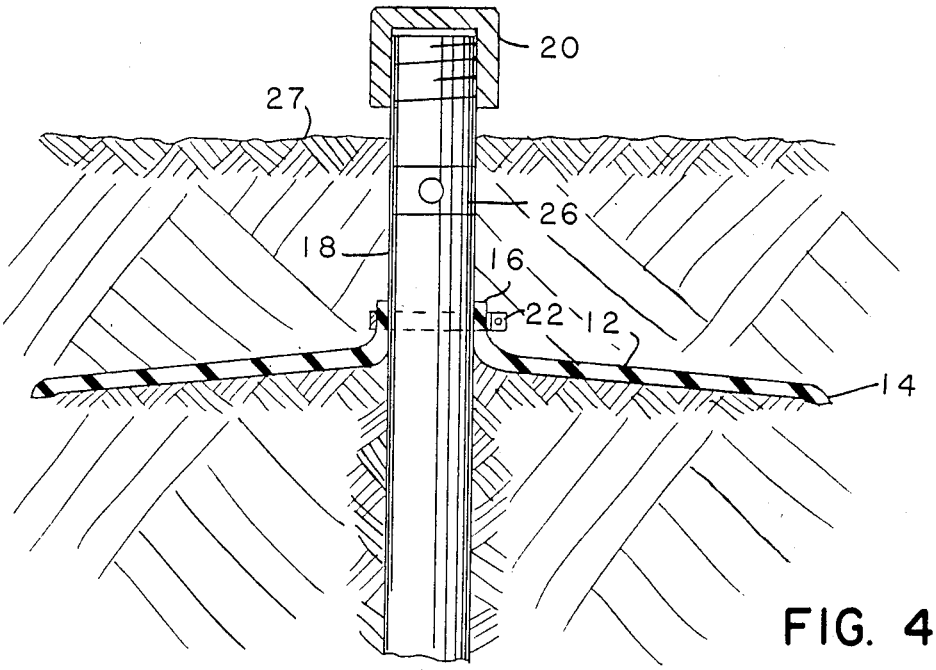
FIG. 4 is a cross sectional view of the flexible pad of FIGS. 1 and 2, installed on the well casing below grade level.

Under some circumstances, it may be advantageous to install the flexible pad below grade level, below the pitless well adapter. Such circumstances might be encountered in areas of such extreme cold or heat that even durable materials for the flexible pad might degrade unduly. Such a subsurface installation is illustrated in FIG. 4. The installation of the flexible pad of the present invention in subsurface installations is the same as with a grade level installation, except that additional excavation is required, and the pad is installed prior to installation of the pitless well adapter, so that the neck of the flexible pad may be conveniently slipped over the well casing without interference with the pitless well adapter. Furthermore, since underground pads are not subject to surface traffic and therefore need not be as flexible as above ground pads, underground pads can be constructed of less flexible materials, such as galvanized steel or similar metallic materials.

Because most pumping units for water wells are electric, it is usually necessary to have electrical conduit from the pump to a supply of electricity. It is therefore preferable that the flexible pad incorporate provision for the electrical conduit. In the present invention, this is accomplished by providing an opening 34 in the skirt near the neck of the pad which is adapted to receive an electrical conduit down through the skirt. The lower surface of the skirt has a groove 36 which is adapted to receive the electrical conduit extending away from the neck of the flexible pad towards the supply of electricity. The opening for the electrical conduit also has a neck 34, similar in construction to the neck for the well casing. This neck can also be conveniently clamped around the electrical conduit with a compression hose clamp 39 to create a water tight seal between the neck and the electrical conduit. Alternately or in addition, a water impermeable conduit grove 36', as shown in FIG. 1, can be provided by molding, stamping, or other convenient means on the upper surface of the skirt 12. With the upper surface groove 36', it is not necessary to provide the neck 34 and hose clamp 39. Thus, the electrical conduit is neatly provided for while retaining the water impermeable features of the flexible pad of the present invention.

It is thus seen that the present invention, provides a water impermeable pad which is flexible, easy to install regardless of temperature conditions, resistant to cracking, and which positively seals against the well casing to prevent undesirable channeling of potentially contaminated water into the aquifer and can be conveniently and safely removed and replaced when maintenance is required.

What is claimed is:

1. A device for preventing external liquid borne contaminants from entering the aquifer of a tubularly cased water well by channeling down around the outside of the casing, said device comprising a water impermeable flexible skirt which is peripherally continuous extending a substantial radial distance away from said casing, said skirt having an opening generally centrally disposed therein for removably receiving the upper terminus of a water well casing therethrough, and means for removably sealingly attaching said skirt to the outer surface of said wter well casing at a fixed location a substantial distance below said terminus.

2. A device for preventing external liquid borne contaminants from entering the aquifier of a tubularly cased water well by channeling down around the outside of the casing, said device comprising:

an upwardly extending, generally tubular, flexible and water impermeable neck which is circumferentially continuous, said neck having an axially disposed opening therethrough which is adapted to be removably received over the upper terminus of said casing, said device further having means for compressibly and removably sealingly attaching said neck to the outer surface of said casing;

a water impermeable flexible skirt which is peripherally continuous sealingly attached to said neck and extending radially outwardly a substantial distance in all directions from said neck, said flexible skirt having a lower surface adapted to be in contact with the earth and an upper surface, said upper surface sloping continuously downwardly and outwardly from said neck to the outermost edge of said skirt.

3. The device defined in claim 2, wherein said skirt is generally rectilinear and said neck is generally centrally disposed with respect to the edges of said skirt.

4. The device defined in claim 2, wherein said skirt is generally circular and said neck is generally centrally disposed with respect to the edges of said skirt.

5. The device defined in claim 2, wherein said skirt is integral with said neck.

6. The device defined in claim 2, wherein said skirt is constructed of an elastomeric material.

7. The device defined in claim 2, wherein said skirt further comprises a molded-in groove in said lower surface of said skirt extending radially outward from the region of said skirt nearest said casing to the edge of said skirt, said groove being adapted to receive an electrical conduit.

8. A cased water well comprising:

a generally tubular water well casing extending from subgrade to above grade, said casing having an opening therein for removing water therefrom;

a device for preventing external liquid borne contaminants from entering the aqufier of a tubularly spaced water well by channeling down around the outside of the casing, said device comprising:

an upwardly extending, generally tubular, flexible and water impermeable neck which is circumferentially continuous, said neck having an axially disposed opening therethrough which is adapted to be removably received over the upper terminus of said casing, said device further having means for compressibly and removably sealingly attaching said neck to the outer surface of said casing at a fixed location a substantial distance below said terminus;

a water impermeable flexible skirt which is peripherally continuous sealingly attached to said neck and extending radially outwardly a substantial distance in all directions from said neck, said flexible skirt having a lower surface adapted to be in contact with the earth and an upper surface, said upper surface sloping continuously downwardly and outwardly from said neck to the outermost edge of said skirt.

9. The cased water well as defined in claim 8, wherein said device is disposed substantially below grade level and covered with fill.

10. The cased water well as defined in claim 8, wherein said flexible skirt is integral with said neck.

* * * * *